US012800193B2

(12) United States Patent
Schaeffer et al.

(10) Patent No.: US 12,800,193 B2
(45) Date of Patent: Nov. 17, 2026

(54) TWO-STAGE REFRIGERATION SYSTEM

(71) Applicant: Hussmann Corporation, Bridgeton, MO (US)

(72) Inventors: Wayne G. Schaeffer, Wildwood, MO (US); Jeffery Marchand, London (CA)

(73) Assignee: HUSSMANN CORPORATION, Bridgeton, MO (US)

( * ) Notice: Subject to any disclaimer, the term of this patent is extended or adjusted under 35 U.S.C. 154(b) by 325 days.

(21) Appl. No.: 18/644,903

(22) Filed: Apr. 24, 2024

(65) Prior Publication Data

US 2024/0353152 A1 Oct. 24, 2024

Related U.S. Application Data

(60) Provisional application No. 63/497,989, filed on Apr. 24, 2023.

(51) Int. Cl.
*F25B 7/00* (2006.01)

(52) U.S. Cl.
CPC ..... *F25B 7/00* (2013.01)

(58) Field of Classification Search
CPC .... F25B 7/00; F25B 1/10; F25B 40/00; F25B 40/02; F25B 40/04; F25B 40/06
See application file for complete search history.

(56) References Cited

U.S. PATENT DOCUMENTS 4,141,708 A 2/1979 Lavigne, Jr. et al.
4,304,100 A 12/1981 Ibrahim
4,594,858 A 6/1986 Shaw
7,644,593 B2 1/2010 Duraisamy
10,458,685 B2 10/2019 Wilkerson et al.
(Continued)

FOREIGN PATENT DOCUMENTS

CN 212157715 U 9/1991
CN 110736262 A 1/2020
(Continued)

OTHER PUBLICATIONS

Dai et al., "Annual energetic evaluation of multi-stage dedicated mechanical subcooling carbon dioxide supermarket refrigeration system in different climate regions of China using genetic algorithm", Journal of Cleaner Production, Publicly available as early as Dec. 13, 2021 (18 pages).
(Continued)

*Primary Examiner* — Miguel A Diaz
(74) *Attorney, Agent, or Firm* — MICHAEL BEST & FRIEDRICH LLP

(57) ABSTRACT

A refrigeration system may include a medium temperature sub-circuit including a medium temperature compressor and a medium temperature evaporator. The system may include a low-temperature sub-circuit including a low temperature compressor and a low temperature evaporator. The system includes a condenser in fluid communication with each of the medium temperature sub-circuit and the low temperature sub-circuit. A first subcooler is in fluid communication with the condenser, the medium temperature sub-circuit, and the low-temperature sub-circuit. A second subcooler is in fluid communication with the condenser via the first subcooler.

20 Claims, 2 Drawing Sheets

(56) References Cited

U.S. PATENT DOCUMENTS

| | | | | |
|---|---|---|---|---|
| 2010/0223939 | A1* | 9/2010 | Mitra | F25B 1/10 62/513 |
| 2022/0003461 | A1* | 1/2022 | Iwata | F25B 40/00 |

FOREIGN PATENT DOCUMENTS

| | | | | |
|---|---|---|---|---|
| CN | 111141054 | A | 5/2020 | |
| CN | 111141055 | A * | 5/2020 | F25B 40/02 |

OTHER PUBLICATIONS

Baik et al., "Two-Stage Refrigeration for SubcoolingLiquid Hydrogen and Oxygen asDensified Propellants", Cryocoolers 13, Abstract, 2005 (7 pages).

* cited by examiner

TWO-STAGE REFRIGERATION SYSTEM

CROSS-REFERENCE TO RELATED APPLICATION

The present application claims priority to U.S. Patent Application No. 63/497,989, filed Apr. 24, 2023, the entire contents of which are hereby incorporated by reference.

BACKGROUND

The present disclosure relates to refrigeration systems, and more particularly to two-stage refrigeration systems.

Refrigeration systems are well known and widely used in supermarkets, warehouses, and elsewhere to refrigerate products that are supported in a refrigerated space, e.g., refrigerated merchandisers, walk-in coolers, etc. Conventional refrigeration systems include a heat exchanger or evaporator, a compressor, and a condenser.

The evaporator provides heat transfer between a refrigerant flowing within the evaporator and a fluid (e.g., water, air, etc.) passing over or through the evaporator. The evaporator transfers heat from the fluid to the refrigerant to cool the fluid. The refrigerant absorbs the heat from the fluid and evaporates in a refrigeration mode, during which the compressor mechanically compresses the evaporated refrigerant from the evaporator and feeds the superheated refrigerant to the condenser, which cools the refrigerant. From the condenser, the cooled refrigerant is typically fed through an expansion valve to reduce the temperature and pressure of the refrigerant, and then the refrigerant is directed through the evaporator.

In many instances the refrigerated spaces are maintained at temperatures to keep certain foods cold and fresh and to keep other foods frozen. As such, these different refrigerated spaces may operate at different temperature ranges. For example, the first temperature range may be between thirty-five degrees Fahrenheit (35° F.) and forty degrees Fahrenheit (40° F.) and the second temperature range may be below zero degrees Fahrenheit (0° F.). To maintain these operating temperatures, the industry is constantly evolving and searching for more efficient ways to operate to maintain these required temperatures in the refrigerated spaces.

SUMMARY

In some aspects, the techniques described herein relate to a refrigeration system including: a medium temperature sub-circuit including a first compressor bank having a medium temperature compressor and a medium temperature evaporator bank having a medium temperature evaporator; a low-temperature sub-circuit including a second compressor bank having a low temperature compressor and a low temperature evaporator bank having a low temperature evaporator; a condenser in fluid communication with each of the medium temperature sub-circuit and the low temperature sub-circuit; a first subcooler in fluid communication with the condenser, the medium temperature sub-circuit, and the low-temperature sub-circuit, the first subcooler configured to subcool refrigerant from the condenser prior to refrigerant entering the medium temperature sub-circuit; and a second subcooler in fluid communication with the condenser via the first subcooler, the second subcooler further in fluid communication with the low temperature sub-circuit, the second subcooler configured to subcool refrigerant from the first subcooler prior to refrigerant entering the low temperature sub-circuit.

In some aspects, the techniques described herein relate to a refrigeration system, wherein the second compressor bank is in fluid communication with the first compressor bank and is configured to compress refrigerant from the low temperature evaporator bank, and wherein the first compressor bank is configured to receive refrigerant from the second compressor bank.

In some aspects, the techniques described herein relate to a refrigeration system, wherein the medium temperature compressor includes a suction intake in fluid communication with the medium temperature evaporator bank and the low temperature compressor.

In some aspects, the techniques described herein relate to a refrigeration system, wherein the medium temperature compressor includes a suction intake in fluid communication with the medium temperature evaporator bank and an interstage port in fluid communication with the low temperature compressor.

In some aspects, the techniques described herein relate to a refrigeration system, further including a fluid line fluidly coupling the first subcooler to the condenser and a branch line extending from the fluid line and including a valve, wherein the first subcooler is configured to receive refrigerant from the fluid line and the branch line in reverse, parallel flow relationship.

In some aspects, the techniques described herein relate to a refrigeration system, further including a subcooler line in fluid communication with the first subcooler to receive refrigerant flowing from the branch line and through the first subcooler, wherein the medium temperature compressor includes a suction intake, an interstage port, and a discharge outlet, and wherein the first subcooler line is fluidly coupled to the interstage port.

In some aspects, the techniques described herein relate to a refrigeration system, further including a fluid line fluidly coupling the second subcooler to the first subcooler and a branch line extending from the fluid line and including a valve, wherein the second subcooler is configured to receive refrigerant from the fluid line and the branch line in reverse, parallel flow relationship.

In some aspects, the techniques described herein relate to a refrigeration system, further including a subcooler line in fluid communication with the second subcooler to receive refrigerant flowing from the branch line and through the second subcooler, wherein the low temperature compressor includes a suction intake, an interstage port, and a discharge outlet, and wherein the subcooler line is fluidly coupled to the interstage port.

In some aspects, the techniques described herein relate to a refrigeration system including: a condenser; a medium temperature compressor in fluid communication with the condenser and configured to circulate a refrigerant; and a low temperature compressor fluidly coupled to and located upstream of the medium temperature compressor, the low temperature compressor in fluid communication with the condenser and configured to discharge compressed refrigerant directly to the medium temperature compressor.

In some aspects, the techniques described herein relate to a refrigeration system, further including a first subcooler in fluid communication only with the medium temperature compressor, and a second subcooler in fluid communication with the medium temperature compressor and the low temperature compressor.

In some aspects, the techniques described herein relate to a refrigeration system, wherein the second subcooler is fluidly coupled to the first subcooler.

In some aspects, the techniques described herein relate to a refrigeration system, wherein the first subcooler is in fluid communication with a fluid line connected to the condenser, and wherein a branch line extends from the fluid line and is configured to direct refrigerant through the first subcooler in reverse, parallel flow relationship relative to refrigerant from the fluid line.

In some aspects, the techniques described herein relate to a refrigeration system, wherein the second subcooler is in fluid communication with a fluid line connected to the first subcooler, and wherein a branch line extends from the fluid line and is configured to direct refrigerant through the second subcooler in reverse, parallel flow relationship relative to refrigerant from the fluid line.

In some aspects, the techniques described herein relate to a refrigeration system, further including a first subcooler, a second subcooler, and a medium temperature evaporator positioned to receive refrigerant from the first subcooler, wherein the second subcooler is downstream of the first subcooler.

In some aspects, the techniques described herein relate to a refrigeration system, further including a low temperature evaporator positioned to receive refrigerant from the second subcooler.

In some aspects, the techniques described herein relate to a refrigeration system, wherein the medium temperature compressor is in fluid communication with the medium temperature evaporator and the low temperature evaporator.

In one aspect, the present disclosure provides a multi-stage refrigeration system that includes at least one medium temperature compressor, and at least one low temperature compressor operably coupled to the at least one medium temperature compressor, wherein the at least one low temperature compressor discharges compressed refrigerant directly to the at least one medium temperature compressor and wherein the at least one medium temperature compressor is located immediately upstream from the at least one low temperature compressor.

Other features and aspects of the invention will become apparent by consideration of the following detailed description and accompanying drawings.

DETAILED DESCRIPTION

Figure 1:
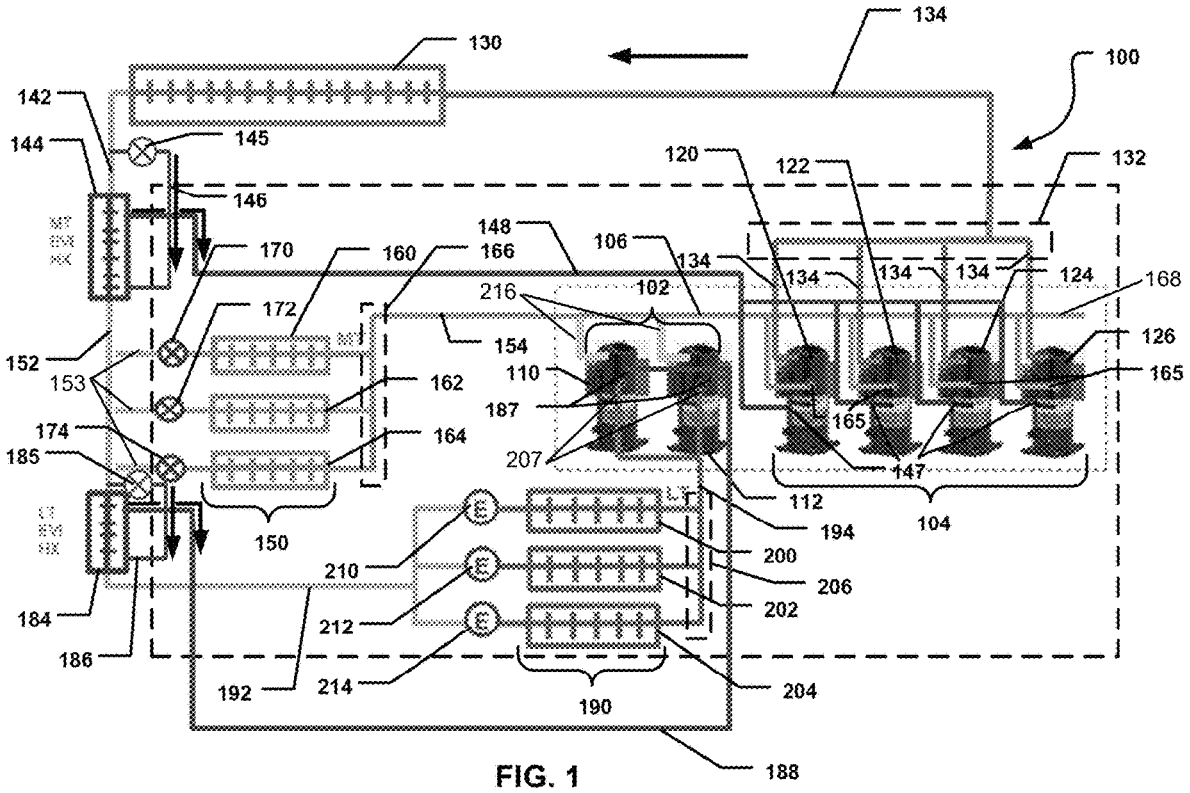
FIG. 1 is a diagram of one example of a refrigeration system.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first," "second," and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Terms of approximation, such as "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction (e.g., clockwise or counterclockwise).

Terms such as "direct" or "directly" are meant to convey a direct coupling (e.g., a fluid coupling) that may include one or more valves disposed between the direct coupling.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

FIG. 1 illustrates an exemplary two-stage refrigeration system 100 that includes a low temperature sub-system and a medium temperature sub-system. As shown, the two-stage refrigeration system 100 includes a low temperature compressor bank 102 operably coupled to and in fluid communication with a medium temperature compressor bank 104 via a first plurality of high-pressure gas discharge lines 106. The low temperature compressor bank 102 includes a plurality of low temperature compressors arranged in parallel with each other. For example, the plurality of low temperature compressors includes a first low temperature compressor 110 and a second low temperature compressor 112. The low temperature compressors 110, 112 may include rotary compressors, scroll compressors, screw compressors, reciprocating compressors, centrifugal compressors, or any combination thereof. In particular, the low temperature compressors 110, 112 may include scroll compressors. While the two-stage refrigeration system 100 is shown as having two low temperature compressors 110, 112, it is to be understood that the two-stage refrigeration system 100 may include any quantity of low temperature compressors (e.g., one, two, or three or more compressors).

The medium temperature compressor bank 104 includes a plurality of medium temperature compressors arranged in parallel with each other. For example, the plurality of medium temperature compressors includes a first medium temperature compressor 120, a second medium temperature compressor 122, a third medium temperature compressor 124, and a fourth medium temperature compressor 126. The medium temperature compressors 120, 122, 124, 126 may include rotary compressors, scroll compressors, screw compressors, reciprocating compressors, centrifugal compressors, or any combination thereof. In particular, the medium temperature compressors 120, 122, 124, 126 may include scroll compressors. While four medium temperature compressors 120, 122, 124, 126 are shown as part of the two-stage refrigeration system 100, it is to be understood that the two-stage refrigeration system 100 may include any quantity of medium temperature compressors (e.g., fewer or more than four compressors).

It is to be understood that the low temperature compressors 110, 112 are directly operably coupled to and fluid communication with the medium temperature compressors 120, 122, 124, 126 that are immediately downstream from the low temperature compressors 110, 112. It is to be further understood that "directly" means that there is not intervening equipment other than one or more valves between the low temperature compressors 110, 112 and the medium temperature compressors 120, 122, 124, 126. As such, during operation, the low temperature compressors 110, 112 of the low temperature compressor bank 102 discharge compressed refrigerant directly into the suction intakes of the medium temperature compressors 120, 122, 124, 126 of the medium temperature compressor bank 104.

As shown in FIG. 1, the two-stage refrigeration system 100 includes one or more medium temperature sub-circuits and one or more low temperature sub-circuits with components (e.g., compressors, condensers) that are used in each sub-circuit, as well as with dedicated components to facilitate refrigerant flow and operation of the system 100. In one non-limiting example, the system 100 includes a condenser 130 that is operably coupled to and in fluid communication with the medium temperature compressor bank 104. In other words, the condenser 130 is operably coupled to and in fluid communication with the first medium temperature compressor 120, the second medium temperature compressor 122, the third medium temperature compressor 124, the fourth medium temperature compressor 126, or any combination thereof. The condenser 130 may be operably coupled to the medium temperature compressors 120, 122, 124, 126 via a manifold 132 and a second plurality of high-pressure gas discharge lines 134. The condenser 130 may be a remote condenser operable to work with the low temperature sub-system and the medium temperature sub-system of the two-stage refrigeration system 100.

The condenser 130 is operably coupled to and in fluid communication with a high-pressure fluid line 142 that directs refrigerant to a medium temperature subcooler 144. As shown in FIG. 1, the high-pressure fluid line 142 does not include an expansion valve (the line 142 may include other control valves, or be provided without any valve), and the refrigeration system 100 includes a valve 145 (e.g., an expansion valve) that is located in a branch line 146 and that may direct a portion of refrigerant from the condenser 130 through the medium temperature subcooler 144 in reverse, parallel flow relationship with the main feed from the condenser 130 (i.e. the high-pressure fluid line 142). Refrigerant that flows from the condenser 130 through the fluid line 142 and within the medium temperature subcooler 144 is in heat exchange relationship with refrigerant flowing through the branch line 146 in reverse flow within the subcooler 144. The reverse, parallel flow arrangement subcools refrigerant flowing along the fluid line 142 within the medium temperature subcooler 144.

The medium temperature subcooler 144 may be a vapor injection heat exchanger (e.g., an economizer heat exchanger). As shown, refrigerant that exits the medium temperature subcooler 144, after flowing through the valve 145 and the subcooler 144 in reverse, parallel flow, is fluidly coupled to (e.g., directly fluidly coupled to) respective interstage ports 147 of one or more of the first medium temperature compressor 120, the second medium temperature compressor 122, the third medium temperature compressor 124, and the fourth medium temperature compressor 126 (singularly or any combination thereof), via a medium temperature subcooler line 148. Each interstage port 147 fluidly couples the medium temperature subcooler line 148 to an interstage pressure area of the associated compressor 120-126 (e.g., at a midpoint, between two consecutive compression stages). Refrigerant that flows from the condenser 130 through the fluid line 142 is in heat exchange relationship with refrigerant flowing through the branch line 146 and in reverse, parallel flow within the medium temperature subcooler 144. It will be appreciated that the medium temperature subcooler line 148 may include one or more valves (e.g., a check valve, a solenoid valve, etc.) to control refrigerant flow to the interstage ports 147.

The medium temperature subcooler 144 is coupled to and in fluid communication with a medium temperature evaporator bank 150 via a medium temperature fluid line 152 and parallel branch lines 153 leading to the medium temperature evaporator bank 150. Subcooled refrigerant flows from the medium temperature subcooler 144 through the fluid line 152 to the medium temperature evaporator bank 150. One or more valves may be included in the medium temperature fluid line 152, in one or more (e.g., all) of the branch lines 153, or any combination of lines 152, 153, to control refrigerant flow based on desired or predetermined parameters.

The medium temperature evaporator bank 150, which may be located in one or more medium temperature refrigerated merchandisers (e.g., operable in a temperature range between approximately 34-41 degrees Fahrenheit), is operably coupled to and in fluid communication with the medium temperature compressor bank 104 via a low-pressure line 154. As shown in FIG. 1, the medium temperature evaporator bank 150 includes a plurality of medium temperature evaporators arranged in parallel with each other. For example, the plurality of medium temperature evaporators includes a first medium temperature evaporator 160, a second medium temperature evaporator 162, and a third medium temperature evaporator 164. While three medium temperature evaporators 160, 162, 164 are shown as part of the two-stage refrigeration system 100, it is to be understood that the two-stage refrigeration system 100 may include any quantity of medium temperature evaporators (e.g., correlating to the quantity of medium temperature merchandisers in the system 100).

As shown, each of the medium temperature evaporators 160, 162, 164 is coupled to and in fluid communication with the first medium temperature compressor 120, the second medium temperature compressor 122, the third medium temperature compressor 124, and the fourth medium temperature compressor 126 via a medium temperature discharge manifold 166 and the low-pressure line 154. It will be appreciated that the low-pressure line 154 may include one or more valves to control refrigerant flow to the compressors 120-126.

Refrigerant flowing through each of the medium temperature evaporators 160, 162, 164 is in heat exchange relationship with an airflow passing through the respective evaporators 160, 162, 164 to condition (e.g., cool or refrigerate) the airflow. The refrigerant absorbs heat from the airflow. The heated, low-pressure refrigerant is discharged from any single or combination of the medium temperature evaporators 160, 162, 164 to one or more suction intakes 165, with each of the first medium temperature compressor 120, the second medium temperature compressor 122, the third medium temperature compressor 124, and the fourth medium temperature compressor 126 having a respective suction intake 165. As shown, the medium temperature discharge manifold 166 may be disposed adjacent and downstream of the medium temperature evaporators 160, 162, 164, and a suction manifold 168 may be disposed adjacent and upstream of the suction intakes 165. It will be appreciated that a reservoir (e.g., an accumulator or other tank) may be disposed between the medium temperature compressor bank 104 and the medium temperature evaporator bank 150 to capture any liquid refrigerant that may be discharged from the medium temperature evaporator bank 150. Also, it will be understood that one or more valves may be disposed in the low-pressure line 154, in or upstream of the medium temperature discharge manifold 166, and/or in or upstream of the suction manifold 168, for example, to control flow of refrigerant within the system based on desired or predetermined parameters (e.g., to control or restrict flow of refrigerant through any of the evaporators 160, 162, 164, or to one or more of the compressors 120, 122, 124, 126). Such valves may include check valves or other control valves that facilitate control of refrigerant flow.

With continued reference to FIG. 1, the illustrated system 100 includes a first medium temperature expansion valve 170, a second medium temperature expansion valve 172, and a third medium temperature expansion valve 174 that are disposed between the medium temperature subcooler 144 and the respective evaporators 160, 162, 164. The expansion valves 170, 172, 174 are fluidly coupled to the medium temperature fluid line 152 (e.g., with or without an intake manifold).

FIG. 1 illustrates that the medium temperature fluid discharge line 152 also is fluidly coupled to a low temperature subcooler 184 (e.g., an economizer heat exchanger) downstream of the intake of the evaporators 160, 162, 164. The medium temperature discharge line 152 defines a low temperature inlet fluid line for the low temperature subcooler 184 and, as shown, the line 152 does not include an expansion valve (the line 152 may include other control valves, or be provided without any control valve). The refrigeration system 100 includes a valve 185 (e.g., an expansion valve) that is located in a branch line 186 and that may direct a portion of refrigerant from the discharge line 152 through the low temperature subcooler 184 in reverse, parallel flow relationship with the main feed from the discharge line 152. Refrigerant that is subcooled by the medium temperature subcooler 144 and that flows from the fluid line 152 into the low temperature subcooler 184 is in heat exchange relationship with refrigerant flowing through the branch line 186. The parallel refrigerant flow arrangement further subcools refrigerant within the low temperature subcooler 184. The low temperature subcooler 184 may be a vapor injection heat exchanger. As shown, refrigerant flowing through the valve 185, the branch line 186, and in reverse flow within the subcooler 184 is fluidly coupled to (e.g., directly fluidly coupled to) a suction of the low temperature compressors 110, 112 at respective interstage ports 187 via a low temperature subcooler line 188. Each interstage port 187 fluidly couples the low temperature subcooler line 188 to an interstage pressure area of the compressors 110, 112 (e.g., at a midpoint, between two consecutive compression stages).

The low temperature subcooler 184 is further operably coupled to and in fluid communication with a low temperature evaporator bank 190 via a low temperature fluid discharge line 192. The low temperature evaporator bank 190, which may be located in one or more low temperature refrigerated merchandisers (e.g., operable in a temperature range below 30 degrees Fahrenheit (e.g., below 20 degrees Fahrenheit) to keep food product frozen), is operably coupled to and in fluid communication with the low temperature compressor bank 102 via a low-pressure line 194. As shown in FIG. 1, the low temperature evaporator bank 190 includes a plurality of low temperature evaporators 200, 202, 204 that are arranged in parallel with each other. While three low temperature evaporators 200, 202, 204 are shown as part of the two-stage refrigeration system 100, it is to be understood that the two-stage refrigeration system 100 may include any quantity of low temperature evaporators (e.g., one, two, or three or more evaporators, correlating to the quantity of medium temperature merchandisers in the system 100).

As shown, the low temperature evaporators 200, 202, 204 are operably coupled to and in fluid communication with the first low temperature compressor 110 and the second low temperature compressor 112 via the low-pressure line 194 (e.g., in communication with a low temperature discharge manifold 206 fluidly coupled to the evaporators 200-204). It will be appreciated that the low-pressure line 194 may include one or more valves to control refrigerant flow to the compressors 110, 112.

Refrigerant flowing through each of the low temperature evaporators 200, 202, 204 is in heat exchange relationship with an airflow passing through the respective evaporators 160, 162, 164 to condition (e.g., cool or refrigerate) the airflow. The refrigerant absorbs heat from the airflow. The heated, low-pressure refrigerant is discharged from any single or combination of the low temperature evaporators 200, 202, 204 to suction intakes 207 of the low temperature compressors 110, 112. Each low temperature compressor 110, 112 includes a corresponding suction intake 207. Each evaporator 200, 202, 204, when operable, discharges heated, low-pressure refrigerant to the suction intake 207 of one, some, or all of the low temperature compressors 110, 112. As shown, the low temperature discharge manifold 206 may be disposed between the low temperature evaporators 200, 202, 204 and the low temperature compressors 110, 112.

With continued reference to FIG. 1, the illustrated system 100 includes a first low temperature expansion valve 210, a second low temperature expansion valve 212, and a third low temperature expansion valve 214 that are disposed between the low temperature subcooler 184 and the low temperature evaporator bank 190 (i.e. one expansion valve is associated with each evaporator). The expansion valves 210, 212, 214 are fluidly coupled to the low temperature liquid discharge line 192 (e.g., via a low temperature intake manifold).

As shown in FIG. 1, the two-stage refrigeration system 100 includes one or more low temperature compressors 110, 112 that discharge compressed refrigerant via a low temperature discharge line 216 to the one or more medium temperature compressors 120, 122, 124, 126 that are located downstream of the low temperature compressor(s) 110, 112. The low temperature discharge line 216 is fluidly coupled to the medium temperature subcooler return line 148. The medium temperature compressors 120, 122, 124, 126 discharges high temperature, high pressure refrigerant to the condenser 130 (e.g., via the manifold 132). It will be appreciated that any quantity of low temperature compressors and medium temperature compressors may be included in the system 100.

The condenser 130 cools refrigerant from the medium temperature compressors 120, 122, 124, 126 via heat exchange with another fluid medium (e.g., air, coolant, or refrigerant). The cooled refrigerant is discharged into the fluid line 142 and is directed to the medium temperature subcooler 144 to be subcooled by heat exchange with refrigerant flowing in reverse, parallel relationship through the subcooler 144 via the line 146. The subcooled refrigerant is discharged from the medium temperature subcooler 144 to the medium temperature evaporator bank 150 and the low temperature subcooler 184 via the medium temperature fluid line 152. The low temperature subcooler 184 receives refrigerant from the medium temperature subcooler 144 (e.g., directly from the subcooler 144). In some embodiments, one or more valves may be disposed in the line 152 to control refrigerant flow to the evaporator bank 150 and to the low temperature subcooler 184.

Refrigerant flowing through the low temperature subcooler 184 via the main feed is further subcooled by heat exchange with refrigerant that is directed through the branch line 186 in reverse, parallel flow relationship with the main feed. As such, refrigerant exiting the subcooler 184 has been twice subcooled or secondarily subcooled, and the refrigerant is delivered to the low temperature evaporator bank 190 via the low temperature fluid discharge line 192, and then the refrigerant flows to at least one of the low temperature compressors 110, 112 before flowing through one or more of the medium temperature compressors 120-126 via line 168 and then to the condenser 130. That is, the system 100 defines a two-stage subcooler system for the low temperature evaporators 200, 202, 204. It is to be understood that the two-stage refrigeration system 100 may include various valves (e.g., directional or check valves, flow control valves, etc.) to prevent backflow of refrigerant and to direct refrigerant to different components or lines in the system 100. For example, check valves may be placed in the discharge lines of the compressors to prevent backflow into the compressors.

Refrigerant flowing through the medium temperature subcooler 144 in reverse, parallel flow relationship with the refrigerant flowing from the high-pressure fluid line 142 flows through the medium temperature subcooler return line 148 to one or more of the medium temperature compressors 120, 122, 124, 126 via the interstage port(s) 147. The refrigerant is compressed and then returns to the condenser 130 via the high-pressure gas discharge line 134. Refrigerant that exits the subcooler 144 and that flows through one or more of the branch lines 153 is expanded prior to entering the corresponding medium temperature evaporator(s) 160, 162, 164. The refrigerant exchanges heat with air flowing through the evaporator(s) 160, 162, 164, and then flows to the medium temperature compressors 120-126 prior to returning to the condenser 130. Refrigerant flowing through the low temperature subcooler 184 in reverse, parallel flow relationship with the refrigerant flowing from the line 152 flows through the low temperature subcooler return line 188 to one or more of the low temperature compressors 110, 112 via the interstage port(s) 187. The refrigerant is compressed by the low temperature compressor(s) 110, 112, flows through the low temperature discharge line 216, into the low-pressure line 154, and through the medium temperature suction manifold 168 into the medium temperature compressor(s) 120-126 to be further compressed before returning to the condenser 130 via the high-pressure gas discharge line 134.

FIG. 1 illustrates an exemplary setup for the system 100 including a configuration of low temperature and medium temperature refrigeration (e.g., for merchandising products or other refrigeration) via a single compressor bank that includes compressors 110, 112 associated with the low temperature evaporator bank 190 and compressors 120-126 associated with the medium temperature evaporator bank 150. The illustrated two-stage system 100 utilizes interstage ports or mid-point vapor injection connections (e.g., interstage ports 147, 187) to facilitate tiered or staged subcooling for refrigerant in the system 100 to facilitate medium temperature refrigeration and low temperature refrigeration while also accommodating different refrigerant pressures associated with low temperature and medium temperature refrigeration. The system 100 provides increased energy efficiencies and reduced mass flow rates to the evaporators 160-164, 200-204 by reducing coil pressure drop (e.g., when utilizing low pressure refrigerants). The system also allows more pressure drop in the liquid lines 142, 152 (e.g., when utilizing low pressure refrigerants).

Figure 2:
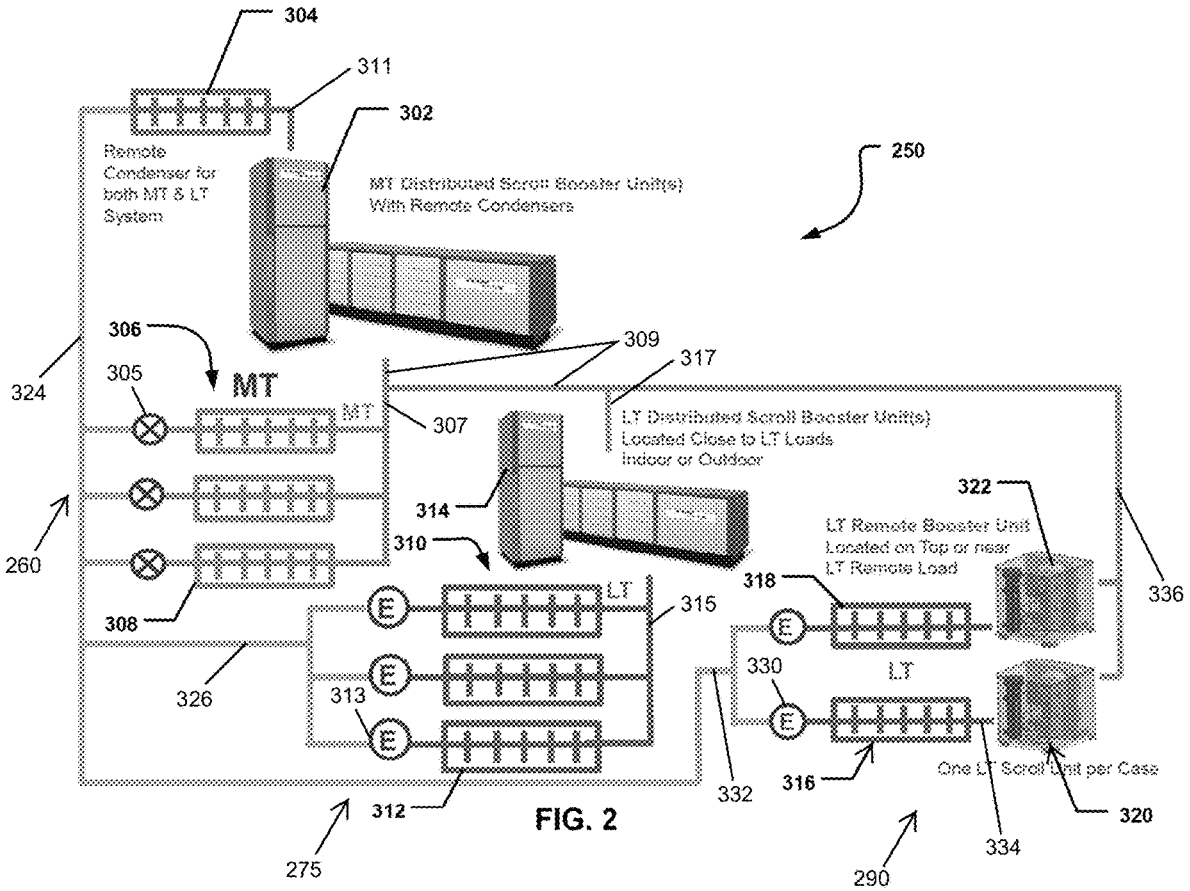
FIG. 2 is a diagram of another example of a refrigeration system.

FIG. 2 illustrates another exemplary two-stage refrigeration system 250 that includes a first configuration in which a stand-alone unit facilitates low temperature refrigeration, and a second configuration in which medium temperature loads and low temperature loads are managed via separate units and field piped together. More specifically, the system 250 includes a medium temperature sub-circuit 260, a first low temperature sub-circuit 275, and a second low temperature sub-circuit 290 circulating refrigerant that is cooled by a common condenser unit 304. Stated another way, the condenser 304 is shared by the medium temperature sub-circuit 260 and the low temperature sub-circuits 275, 290 to cool the refrigerant circulated through each of the sub-circuits 260, 275, 290. It will be appreciated that the system 250 may include any quantity of medium temperature sub-circuits and any quantity of low temperature sub-circuits.

The medium temperature sub-circuit 260 includes a medium temperature compressor bank 302 (e.g., including one or more compressors, such as scroll compressors or another type of compressor) that is fluidly coupled to the condenser 304, and a medium temperature evaporator bank 306 that has one or more evaporators 308 and associated expansion valves 305 on the liquid line that feeds refrigerant to the evaporator bank 306. The compressor bank 302 may include distributed compressors, and may have one or more compressors depending on the size and desired characteristics of the system 250. Refrigerant from the condenser 304 flows through a main liquid line 324 into one or more branch lines leading to the evaporator bank 306. Refrigerant exiting the evaporator bank 306 is directed to the medium temperature compressor bank 302 via a medium temperature suction line 307 and a main suction line 309. The compressor bank 302 is fluidly coupled to the condenser 304 by a discharge line 311. In some examples, the branch lines may connect to a liquid line manifold, and the suction line 307 may connect to a suction line manifold at or adjacent the outlet of the evaporator bank 306. It will be appreciated that additional valves may be included in the main liquid line feed or in each branch line leading to the evaporator bank 306 to control refrigerant flow. In addition or separately, one or more valves may be included in the suction line 307 (or upstream of the suction line manifold) to control refrigerant flow to the compressor bank 302 (e.g., to prevent liquid refrigerant from entering the compressor bank 302). Other refrigeration components may be included in the medium temperature sub-circuit 260 to control refrigerant flow and to manage the system 250 according to desired or predetermined parameters.

The first low temperature sub-circuit 275 includes a low temperature compressor bank 314 (e.g., including one or more compressors such as scroll compressors or other compressors, based on the size and desired characteristics of the system 250), and a first low temperature evaporator bank 310 that has one or more evaporators 312 and associated expansion valves 313 on the liquid line 326 that feeds refrigerant to the evaporator bank 310. The compressor bank 310 may include distributed compressors. Refrigerant from the condenser 304 enters the evaporator bank 310 via the main liquid line 324 and a liquid line 326 due to at least a portion of refrigerant bypassing the medium temperature sub-circuit 260 (via one or more control valves). Refrigerant exiting the evaporator bank 310 is directed to the first low temperature compressor bank 314 via a first low temperature suction line 315. The compressor bank 314 is fluidly coupled to the main suction line 309 by a secondary discharge line 317, and the main suction line 309 directs the refrigerant compressed by the compressor bank 314 to the medium temperature compressor bank 302. The low temperature refrigerant is compressed again by the medium temperature compressor bank 302 before flowing to the condenser 304 via the discharge line 311. In some examples, the branch lines fluidly connected to the evaporator bank 310 may connect to a liquid line manifold, and the suction line 315 may connect to a suction line manifold at or adjacent the outlet of the evaporator bank 310. It will be appreciated that additional valves may be included in the main liquid line feed or in each branch line leading to the evaporator bank 310 to control refrigerant flow. In addition or separately, one or more valves may be included in the suction line 315 (or upstream of the suction line manifold) to control refrigerant flow to the compressor bank 314 (e.g., to prevent liquid refrigerant from entering the compressor bank 314). Other refrigeration components may be included in the first low temperature sub-circuit 275 to control refrigerant flow and to manage the system 250 according to desired or predetermined parameters.

The second low temperature sub-circuit 290 includes a low temperature compressor bank 320 (e.g., including one or more compressors 322, such as scroll compressors or another type of compressor) and a second low temperature evaporator bank 316 that has one or more evaporators 318 and associated expansion valves 330 on the liquid line that feeds refrigerant to the evaporator bank 316. The compressor bank 320 may include distributed compressors, and may have one or more compressors depending on the size and desired characteristics of the system 250. Refrigerant from the condenser 304 enters the evaporator bank 316 via the main liquid line 324 and a liquid line 332 due to at least a portion of refrigerant bypassing the medium temperature sub-circuit 260 (via one or more control valves) and the first low temperature sub-circuit 275 (via one or more control valves). Refrigerant exiting the evaporator bank 316 is directed to the second low temperature compressor bank 320 via a second low temperature suction line 334. In one example, each evaporator 318 may connect to a dedicated compressor 322 via separate suction lines 334. The compressor bank 320 is fluidly coupled to the main suction line 309 by a secondary discharge line 336, and the main suction line 309 directs the refrigerant compressed by the compressor bank 320 to the medium temperature compressor bank 302. The low temperature refrigerant from the second sub-circuit 290 is compressed again by the medium temperature compressor bank 302 before flowing to the condenser 304 via the discharge line 311. In some examples, the branch lines fluidly connected to the evaporator bank 316 may connect to a liquid line manifold, and the suction line 334 may connect to a suction line manifold at or adjacent the outlet of the evaporator bank 316. It will be appreciated that additional valves may be included in the main liquid line feed or in each branch line leading to the evaporator bank 316 to control refrigerant flow. In addition or separately, one or more valves may be included in the suction line 334 (or upstream of the suction line manifold) to control refrigerant flow to the compressor bank 320 (e.g., to prevent liquid refrigerant from entering the compressor bank 320). Other refrigeration components may be included in the first low temperature sub-circuit 275 to control refrigerant flow and to manage the system 250 according to desired or predetermined parameters.

It will be appreciated that additional medium temperature and/or low temperature sub-circuits may be included in the system 250. Also, any of the refrigerant lines may include one or more valves (e.g., check valves, control valves) and/or other components to control and facilitate refrigerant flow and, where appropriate, to prevent backflow. Each of the low temperature compressors or banks 314, 320 may take the form of a remote booster unit that is operably coupled to and in fluid communication with the at medium temperature compressor bank 302. It is to be understood that any of the compressor banks described herein may be distributed compressors that are located close to the cooling loads indoors or outdoors, or remote compressors that may be located on top of or near one or more remote cooling loads.

Although the invention has been described in detail with reference to certain preferred embodiments, variations and modifications exist within the scope and spirit of one or more independent aspects of the invention as described.

Various features of the invention are set forth in the following claims.

The invention claimed is:

1. A refrigeration system comprising:

a medium temperature sub-circuit including a first compressor bank having a medium temperature compressor and a medium temperature evaporator bank having a medium temperature evaporator, the medium temperature compressor having a suction intake, an interstage port, and a discharge outlet;

a low temperature sub-circuit including a second compressor bank having a low temperature compressor and a low temperature evaporator bank having a low temperature evaporator;

a condenser in fluid communication with each of the medium temperature sub-circuit and the low temperature sub-circuit;

a first subcooler in fluid communication with the condenser, the medium temperature sub-circuit, and the low temperature sub-circuit, the first subcooler configured to subcool refrigerant from the condenser prior to refrigerant entering the medium temperature sub-circuit;

a second subcooler in fluid communication with the condenser via the first subcooler, the second subcooler further in fluid communication with the low temperature sub-circuit, the second subcooler configured to subcool refrigerant from the first subcooler prior to refrigerant entering the low temperature sub-circuit;

a first fluid line fluidly coupling the first subcooler to the condenser and a first branch line extending from the first fluid line; and a first subcooler line in fluid communication with the first subcooler to receive refrigerant flowing from the first branch line and through the first subcooler, and the first subcooler line fluidly coupled to the interstage port.

2. The refrigeration system of claim 1, wherein the second compressor bank is in fluid communication with the first compressor bank and is configured to compress refrigerant from the low temperature evaporator bank, and wherein the first compressor bank is configured to receive refrigerant from the second compressor bank.

3. The refrigeration system of claim 2, wherein the suction intake is in fluid communication with the medium temperature evaporator bank and the low temperature compressor.

4. The refrigeration system of claim 1, wherein the suction intake is in fluid communication with the temperature evaporator bank.

5. The refrigeration system of claim 1, wherein the first branch line includes a valve and the first subcooler is configured to receive refrigerant from the first fluid line and the first branch line in reverse, parallel flow relationship.

6. The refrigeration system of claim 1, further comprising a second fluid line fluidly coupling the second subcooler to the first subcooler and a second branch line extending from the second fluid line and including a valve, wherein the second subcooler is configured to receive refrigerant from the second fluid line and the second branch line in reverse, parallel flow relationship.

7. The refrigeration system of claim 6, further comprising a second subcooler line in fluid communication with the second subcooler to receive refrigerant flowing from the second branch line and through the second subcooler, wherein the low temperature compressor includes a low temperature suction intake, a low temperature interstage port, and a low temperature discharge outlet, and wherein the second subcooler line is fluidly coupled to the low temperature interstage port.

8. A refrigeration system comprising:

a condenser;

a medium temperature evaporator in fluid communication with the condenser;

a medium temperature compressor in fluid communication with the condenser and configured to circulate a refrigerant;

a low temperature compressor fluidly coupled to and located upstream of the temperature compressor, the low temperature compressor in fluid communication with the condenser and configured to discharge compressed refrigerant directly to the temperature compressor;

a first subcooler in direct fluid communication with the condenser to receive refrigerant therefrom, the first subcooler further directly fluidly coupled to the temperature compressor and directly fluidly coupled to the temperature evaporator, and the first subcooler configured to subcool refrigerant from the condenser prior to refrigerant entering the temperature evaporator;

a second subcooler in fluid communication with the condenser and configured to receive refrigerant from the condenser via the first subcooler.

9. The refrigeration system of claim 8, wherein the second subcooler is in fluid communication with the temperature compressor, the low temperature compressor, and a low temperature evaporator.

10. The refrigeration system of claim 9, wherein the second subcooler is directly fluidly coupled to the first subcooler.

11. The refrigeration system of claim 9, wherein the first subcooler is in fluid communication with a fluid line connected to the condenser, and wherein a branch line extends from the fluid line and is configured to direct refrigerant through the first subcooler in reverse, parallel flow relationship relative to refrigerant from the fluid line.

12. The refrigeration system of claim 9, wherein the second subcooler is in fluid communication with a fluid line connected to the first subcooler, and wherein a branch line extends from the fluid line and is configured to direct refrigerant through the second subcooler in reverse, parallel flow relationship relative to refrigerant from the fluid line.

13. The refrigeration system of claim 8, further comprising a low temperature evaporator, wherein each of the low temperature compressor and the low temperature evaporator is positioned to receive refrigerant directly from the second subcooler.

14. The refrigeration system of claim 13, wherein the temperature compressor is in fluid communication with the temperature evaporator and the low temperature evaporator.

15. A refrigeration system comprising:

a medium temperature sub-circuit including a first compressor bank having a medium temperature compressor and a medium temperature evaporator bank having a medium temperature evaporator;

a low temperature sub-circuit including a second compressor bank having a low temperature compressor and a low temperature evaporator bank having a low temperature evaporator, the low temperature compressor having a suction intake, an interstage port, and a discharge outlet;

a condenser in fluid communication with each of the temperature sub-circuit and the low temperature sub-circuit;

a first subcooler in fluid communication with the condenser via a first fluid line, and the first subcooler further in fluid communication with the temperature sub-circuit, and the low temperature sub-circuit, the first subcooler configured to subcool refrigerant from the condenser prior to refrigerant entering the temperature sub-circuit;

a second subcooler fluidly coupled to the first subcooler via a second fluid line and in fluid communication with the condenser via the first subcooler, the second subcooler further in fluid communication with the low temperature sub-circuit and configured to subcool refrigerant from the first subcooler prior to refrigerant entering the low temperature sub-circuit; and a subcooler line in fluid communication with the second subcooler to receive refrigerant flowing through the second subcooler, and the subcooler line fluidly coupled to the interstage port.

16. The refrigeration system of claim 15, wherein the second compressor bank is in fluid communication with the first compressor bank and is configured to compress refrigerant from the low temperature evaporator bank, and wherein the first compressor bank is configured to receive refrigerant directly from the second compressor bank.

17. The refrigeration system of claim 16, wherein the suction intake is in fluid communication with the low temperature evaporator bank.

18. The refrigeration system of claim 15, wherein the first subcooler is directly fluidly coupled to the condenser and the second subcooler is directly fluidly coupled to the first subcooler.

19. The refrigeration system of claim 18, further comprising a first branch line extending from the first fluid line and configured to direct refrigerant through the first subcooler in reverse, parallel flow relationship relative to refrigerant from the first fluid line.

20. The refrigeration system of claim 19, further comprising a second branch line extending from the second fluid line and configured to direct refrigerant through the second subcooler in reverse, parallel flow relationship relative to refrigerant from the second fluid line.

* * * * *